United States Patent [19]

Schönwald

[11] 4,451,211

[45] May 29, 1984

[54] RADIAL PISTON COMPRESSOR AND DRIVE MOTOR COUPLING ARRANGEMENT

[75] Inventor: Siegfried Schönwald, Bad Neustadt, Fed. Rep. of Germany

[73] Assignee: Siemens Aktiengesellschaft, Berlin and Munich, Fed. Rep. of Germany

[21] Appl. No.: 379,554

[22] Filed: May 18, 1982

[30] Foreign Application Priority Data

Jun. 2, 1981 [DE] Fed. Rep. of Germany ..... 3121874

[51] Int. Cl.[3] ..... F04B 35/04; F04B 17/00

[52] U.S. Cl. ..... 417/271

[58] Field of Search ..... 417/271, 273; 91/491, 91/498; 464/69

[56] References Cited

U.S. PATENT DOCUMENTS 4,019,346 4/1977 Fukuda ..... 464/69

FOREIGN PATENT DOCUMENTS 667359 10/1938 Fed. Rep. of Germany ..... 417/271
587413 4/1925 France ..... 91/498
661607 7/1929 France ..... 417/271
1566687 5/1980 United Kingdom .
362155 2/1973 U.S.S.R. ..... 464/69

*Primary Examiner*—William L. Freeh
*Attorney, Agent, or Firm*—Kenyon & Kenyon

[57] ABSTRACT

A coupling arrangement for coupling a radial piston compressor to an external rotor drive motor is disclosed. The rotor of the drive motor is coupled to a rotatable cylinder block by arranging a plurality of leaf springs between the cylinder block and arms projecting from the rotor. The cylinder block rotatably mounted on the motor stator shaft supports the rotor at the compressor end of the drive motor. The leaf springs prevent canting of the cylinder blocks with respect to the rotor of the drive motor due to manufacturing and alignment errors.

2 Claims, 2 Drawing Figures

RADIAL PISTON COMPRESSOR AND DRIVE MOTOR COUPLING ARRANGEMENT

BACKGROUND OF THE INVENTION

1. Field of the Invention

The present invention relates to compressors, and particularly to a coupling arrangement for a radial piston compressor and drive motor, in which the rotor of the drive motor is connected to the cylinder block of a radial piston compressor and is supported radially by the latter.

2. Description of the Prior Art

A radial piston compressor in which the rotor of the drive motor is coupled to the compressor cylinder block is known from British Pat. No. 1,566,687. In this arrangement, the cylinder block is rigidly connected to arms of an external rotor drive motor. The drive motor rotor does not have a shaft bearing of its own on the compressor end of the rotor, but is supported radially by the cylinder block itself. Due to manufacturing tolerances, alignment errors occur between the rotor and the cylinder block. Such alignment errors lead to canting of the cylinder block if the cylinder block is connected rigidly to the arms of the rotor. This stresses the bearings of the cylinder block unequally.

It is accordingly an object of the present invention to develop an apparatus for coupling the drive motor rotor to the radial piston compressor cylinder block in such a manner that on the one hand, canting of the cylinder block because of alignment errors between the rotor and the cylinder block is prevented and on the other hand, support for the rotor by the cylinder block is assured without bearing damage.

SUMMARY OF THE INVENTION

According to the present invention, the stated problem can be solved by coupling the rotor and the cylinder block to each other with a flexible coupling. By means of such a coupling, radial forces, such as the magnetic pull of the rotor transverse to the stator axis as well as the motor's torque can be transmitted practically rigidly. The arrangement however, compensates for alignment errors between the cylinder blocks and the rotor which would otherwise cause damaging stresses if the two components were rigidly connected.

According to a further embodiment of the invention, a particularly simple coupling arrangement is obtained by designing the flexible coupling in the form of a plurality of leaf springs which are each fastened at one end to the cylinder block and at the other end to projections or arms of the rotor approximately in the center plane of the cylinder block, with one of the ends of each of the leaf springs fastened securely against twisting stresses. Such leaf springs are relatively flexible in the axial direction and rigid in the radial and tangential directions so that they compensate for alignment errors between the parts coupled to each other. The rigidity in the radial and tangential direction can be increased further by making the leaf springs V-shaped and fastening one leg of each leaf spring to two points of the cylinder block spaced apart from each other.

Additional objects and features of the invention will appear from the following description in which the preferred embodiment has been set forth in detail in connection with the accompanying drawings.

DETAILED DESCRIPTION

Figure 2:
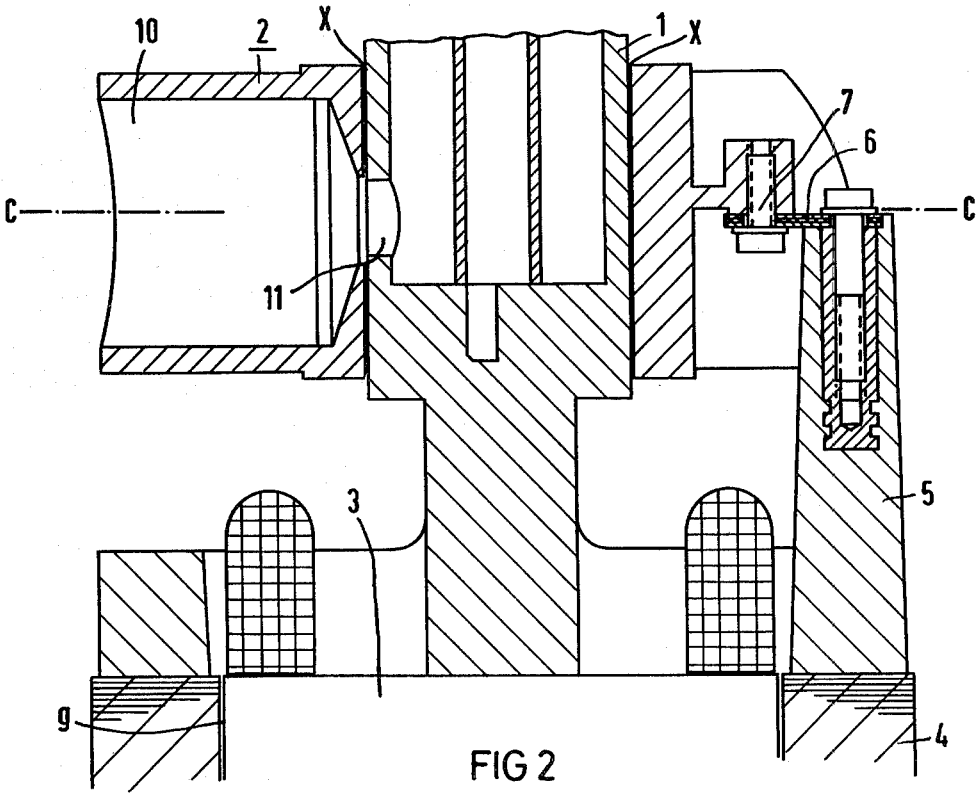
FIG. 2 illustrates the coupling arrangement of FIG. 1 in a sectional view along the line II—II in FIG. 1.

With reference to the drawings, a compressor cylinder block 2 (of which one cylinder 10 is shown in FIG. 2) is rotatably supported on a fixed shaft 1. Connected to the fixed shaft 1 is the inner stator 3 of an external-rotor drive motor. The external rotor 4 of the drive motor has a plurality of axially projecting arms 5. The end of the rotor opposite the cylinder block is guided radially and axially by an antifriction bearing (not shown) and the other end is supported radially via the coupling arrangement by the cylinder block 2 which is itself supported by the fixed shaft 1. This ensures a uniform motor air gap, denoted by g in FIG. 2.

Figure 1:
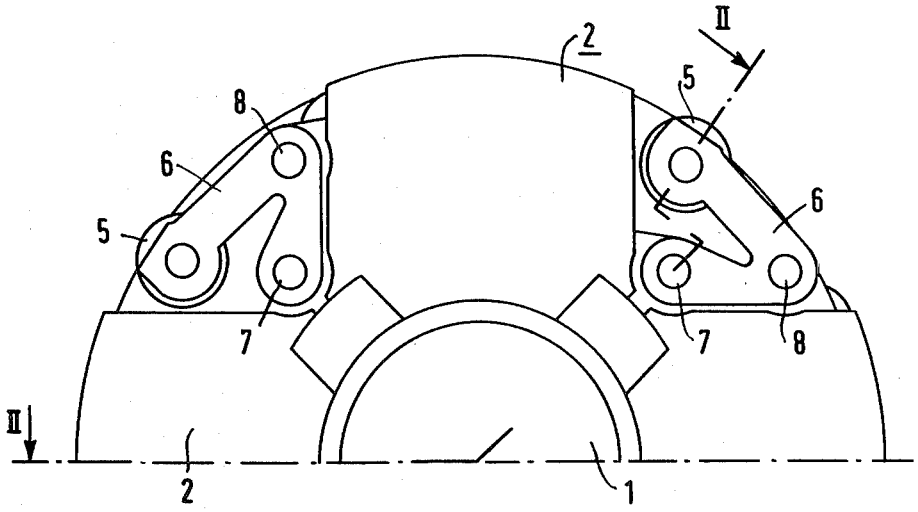
FIG. 1 is a cross-sectional view of the coupling arrangement viewed looking into one-half of the cylinder block from the motor end of the compressor.

The coupling between each of the arms 5 and the cylinder block 2 is accomplished via leaf springs 6 designed in a V-shape as shown in FIG. 1. As illustrated in FIG. 2, the leaf springs 6 are composed of a plurality of leafs stacked on top of each other in several layers. The leaf springs 6 are fastened to the cylinder block 2 through one leg at two points 7 and 8 spaced apart from each other. These fastening points are located approximately in the center plane of the cylinder block 2 as shown by line C in FIG. 2. The other legs of each of the leaf springs 6 are connected to the arms 5 of the external rotor 4. Due to the three-point fastening of each of the leaf springs 6, they are very rigid in the radial and tangential direction so that they can transmit large forces in these directions without the occurrence of deflection or displacement of the leaf springs 6. Thus, a separate support of the compressor end of the rotor 4 on the shaft 1 is unnecessary. In the axial direction, however, the connection of the external rotor 4 to the cylinder block 2 is relatively elastic if the leaf springs are arranged in several layers, so that the cylinder block 2 adjusts itself relative to the external rotor 4 in the event of alignment deviations without change of the motor air gap g.

This coupling arrangement is particularly advantageous if, with direct support of the cylinder block 2 on the fixed shaft 1, the gap x between the cylinder block 2 and the fixed shaft 1 has a cross section decreasing in the direction from the suction slot 11 to the output slot (not shown) in order to obtain in the gap an oil pressure which increases from the suction slot toward the output slot to prevent loss of output pressure. Due to the elasticity of the leaf springs 6 in the axial direction, the cylinder block 2 will always adjust itself so that canting of the cylinder block relative to the fixed shaft 1 does not occur. Such canting would result in an uneven gap in the axial direction, and the oil supply could not seal it sufficiently, thereby resulting in loss of compressor output pressure through the gap.

What is claimed is:

1. In a compressor apparatus of the type having a radial piston compressor including a rotative cylinder block and a drive motor including a rotor coupled to the cylinder block, the rotor being supported in the radial direction by the cylinder block adjacent the cylinder block, the improvement comprising:

a plurality of projecting arms extending axially towards said cylinder block from said rotor; and leaf spring means coupling each of said projecting arms to said cylinder block, said leaf spring means being disposed in approximately the center plane of the cylinder block, said leaf spring means having two ends, one of said ends being fastened to said cylinder block and the other end being fastened to one of said projecting arms, one of said ends of said leaf spring means having two fastening points spaced apart from each other so that said leaf spring means are flexible in the axial direction of said rotor but are substantially rigid in the radial and tangential directions.

2. The improvement according to claim 1, wherein each of said leaf spring means have a V-shape having two legs, one leg of said V-shaped leaf spring means being fastened to said cylinder block by said two fastening points spaced apart from each other, and the other leg being fastened to one of said projecting arms.

* * * * *